US009863727B1

(12) United States Patent
Van Fleet

(10) Patent No.: US 9,863,727 B1
(45) Date of Patent: Jan. 9, 2018

(54) MOBILE HYDRO-BLASTING EQUIPMENT AND TUBE LANCING CONTAINMENT SYSTEM

(71) Applicant: David C. Van Fleet, College Station, TX (US)

(72) Inventor: David C. Van Fleet, College Station, TX (US)

( * ) Notice: Subject to any disclaimer, the term of this patent is extended or adjusted under 35 U.S.C. 154(b) by 13 days.

(21) Appl. No.: 15/206,863

(22) Filed: Jul. 11, 2016

(51) Int. Cl.
*F28G 1/16* (2006.01)
*B08B 9/032* (2006.01)
*B08B 13/00* (2006.01)

(52) U.S. Cl.
CPC ..... *F28G 1/163* (2013.01); *B08B 9/0321* (2013.01); *B08B 9/0325* (2013.01); *B08B 13/00* (2013.01)

(58) Field of Classification Search
CPC ..... F28G 1/163; B08B 9/0321; B08B 9/0325; B08B 13/00
See application file for complete search history.

(56) References Cited

U.S. PATENT DOCUMENTS 2,857,922 A 10/1958 Effinger
3,389,713 A * 6/1968 Pittman ..... B08B 9/027 134/167 R
3,736,909 A 6/1973 Marangoni et al.
4,460,005 A 7/1984 Rodger
4,460,995 A 7/1984 Rodger
4,498,427 A * 2/1985 Todd ..... B05B 15/00 122/290
4,805,653 A * 2/1989 Krajicek ..... B08B 9/0323 134/166 C
5,018,544 A 5/1991 Boisture et al.
5,261,600 A 10/1993 Cradeur
5,322,080 A * 6/1994 Rankin ..... B05B 1/14 134/167 C
5,437,296 A 8/1995 Citino
5,657,781 A * 8/1997 Steverson ..... B08B 3/02 134/144
7,334,587 B2 2/2008 Lake
7,575,641 B2 8/2009 Joseph
8,652,265 B2 2/2014 Hays
9,032,979 B2 5/2015 Hays
2009/0255557 A1* 10/2009 Gardner ..... B08B 9/04 134/18
2012/0067370 A1* 3/2012 Crock ..... B08B 9/043 134/6
2014/0158169 A1 6/2014 Hays
2015/0068563 A1* 3/2015 Gzym ..... F28G 15/04 134/168 C
2015/0266623 A1 9/2015 Earp

* cited by examiner

*Primary Examiner* — Michael Barr
*Assistant Examiner* — Benjamin L Osterhout
(74) *Attorney, Agent, or Firm* — Douglas Baldwin

(57) ABSTRACT

A mobile multi-function hydro-blast cleaning and tube lancing apparatus and system built into a containment vessel (tank) to enable it to be transported to a facility with ease and preform hydro-blasting/tube lancing with the ability to contain all the fluids involved in the cleaning and lancing process. The system comprises several key pieces of machinery working within a containment tank to make the process of cleaning more versatile. All the cleaning and lancing equipment is either controlled by the operator or computer automation that has been preprogrammed for a more hands free environment.

15 Claims, 7 Drawing Sheets

MOBILE HYDRO-BLASTING EQUIPMENT AND TUBE LANCING CONTAINMENT SYSTEM

BACKGROUND

Field of Invention

Cleaning heat exchanger tube bundles and other fouled equipment by hydro-blasting and lance tube cleaning, specifically a mobile self-contained cleaning and debris containment system.

Background

Industrial process plant heat exchangers require periodic cleaning, but since they are typically massive heavy structure in toxic chemical service, proper cleaning is a challenge. It has been customary to hydro-blast clean and rod or lance the tubes of heat exchanger bundles on open concrete pads or other unprotected locations. However, since the debris is often toxic and an environmental hazard this is undesirable and increasingly controlled by regulation. Heat exchangers and the need for periodic cleaning are well known and adequately described in the patent literature—see, for example, U.S. Pat. No. 3,736,909, issued Jun. 5, 19763 and U.S. Pat. No. 5,261,600, issued Nov. 16, 1993 that describe industrial heat exchangers and cleaning of the tubes of a tube bundle. U.S. Pat. No. 7,334,587, issued Feb. 26, 2008 describes a system for containment of the water and debris of hydro-blast cleaning.

Patents, including U.S. Pat. No. 7,575,641, issued Aug. 18, 2009, U.S. Pat. No. 8,652,265, issued Feb. 18, 2014 and U.S. Pat. No. 5,437,296, issued Aug. 1, 1995 propose self-contained systems with vessels for emerging the equipment in cleaning baths. However, there is a need for a self-contained mobile hydro-blast, high pressure tube lance cleaning system. The present invention is such a system.

DETAILED DESCRIPTION

In broad scope the invention is a mobile multi-function hydro-blast cleaning and tube lancing apparatus and system built into a containment vessel (tank). The purpose of the apparatus and system is to enable it to be transported to a facility with ease and preform hydro-blasting/tube lancing with the ability to contain all the fluids involved in the cleaning and lancing process. The system comprises several key pieces of machinery working within a containment tank to make the process of cleaning more versatile. All the cleaning and lancing equipment is either controlled by the operator or computer automation that has been preprogrammed for a more hands free environment.

Figure 1:
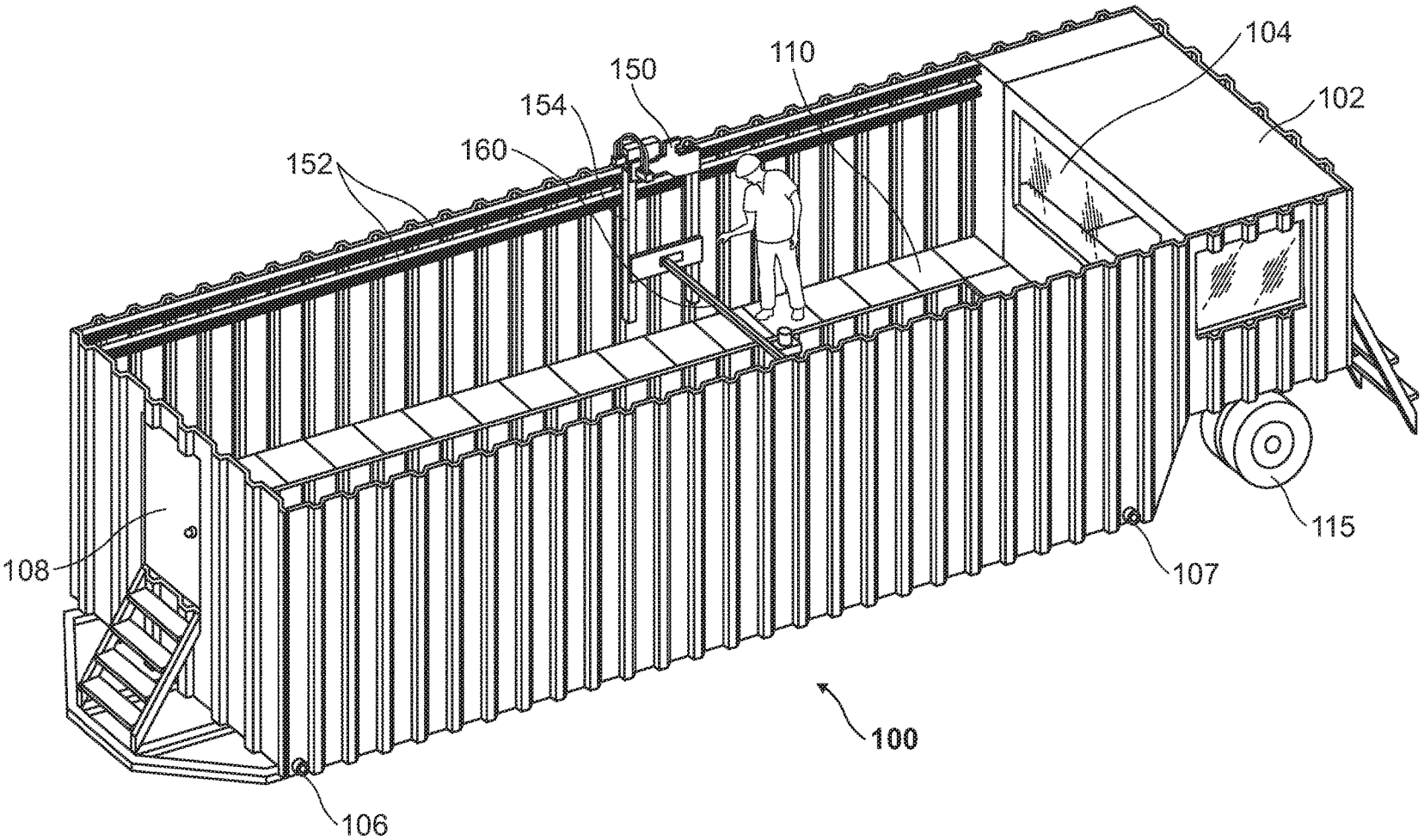
FIG. 1 is a perspective view of an embodiment of a hydro-blast cleaning containment system of the invention.
Figure 2:
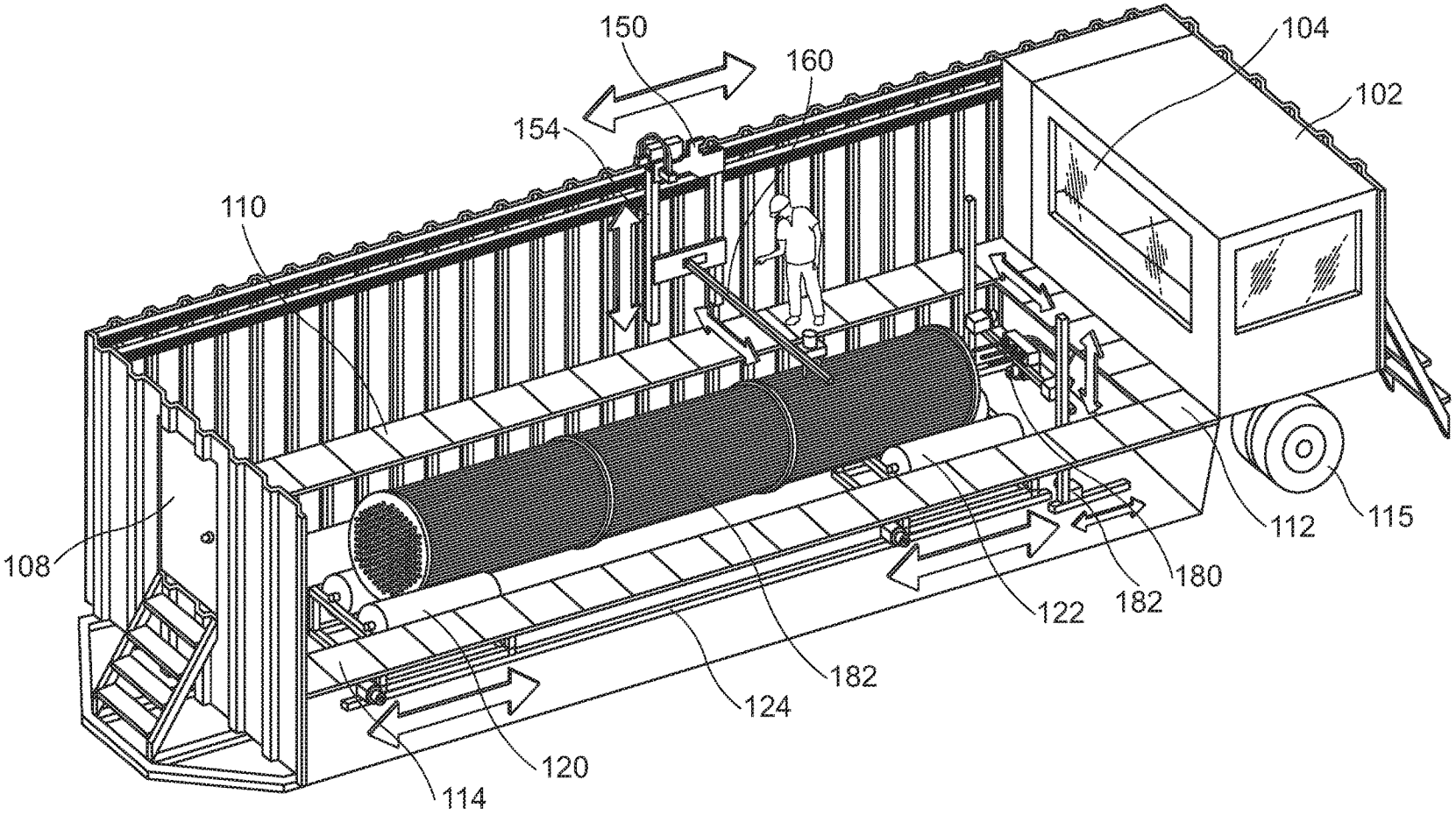
FIG. 2 is another perspective view of an embodiment of a hydro-blast cleaning containment system of the invention showing more detail.

Referring to the Figures, FIG. 1 shows the containment vessel of embodiments of the invention. The containment vessel, 100, has an operator cabin 102 with a window that allows an operator to observe operations of the system in the main section of the containment vessel. On at least one side of the vessel, near the top, is disposed a toothed rail to allow a hydro-blast arm 160 to traverse the length of the open section of the vessel. The arm is moved along the track, 152, by the hydraulic tractor drive assembly 150 (described in more detail in reference to FIG. 3). In the embodiment shown in FIG. 1 there is an access door 108 in the containment vessel to allow access to the main section of the containment vessel. There are drain ports (outlets) 106 and 107 (a similar ports or outlet on the opposite side) to allow waste water and debris from the cleaning operation to be removed. Generally these will be capped with removable caps or fitted with suitable valves. Typically the waste water and debris from cleaning operations will be taken off in vacuum truck or trailers for disposal. It may also be transferred to a waste water disposal pit or to a tank or other container in the facility from which the equipment that is cleaned is taken. The containment vessel is shown with a flat bottom, but it may have a sloped bottom or a concave or V shaped bottom to facilitate removal of cleaning water and debris. It may also have a section with a sump depression to collect water and debris. The drain ports may be disposed on the bottom and/or the sides as illustrated. The containment vessel is intended to be mobile to allow it to be moved to an appropriate facility. As shown it has wheels 115. It may also be mobilized by winching the tongue on a semi-trailer truck. FIG. 2 shows the same embodiment as FIG. 1 and also shows a tube bundle (exchanger) 182 disposed in the vessel. The containment vessel has walkway(s) (platforms) 110,112 and 114 located around the inside wall, attached to the walls and at a height to allow a person to stand in the vessel above the bottom and at a height to allow working on the equipment. The tube bundle, 182, rests on roller systems 120 and 122, a system that will allow a circular tube bundle to be rotated. Typically the roller system will be have hydraulic motors to rotate—the rotation preferable being controlled by a programmed control system (described herein after). The roller systems are disposed on tracks 124 to allow then to be moved front to back in the containment vessel so that they may be adjusted to different length tube bundles. Tube bundles for cleaning are illustrated herein but the system may also be used for cleaning any other equipment. The support for the equipment (here shown as roller system) will be designed to be suitable for the equipment. It may be simple racks, bars extending across the bottom, a shaped supports and the like.

The containment vessel may be of any suitable size for the equipment to be cleaned. A typical, prototype vessel for cleaning large tube bundles is, illustratively, be about 45 feet long, 8-9 feet wide (generally needs to be of no greater width than will be allowed to be transported on roadways—ca. 8.5 feet) and about 10 feet high (side walls). The operator's cabin with a width extending into the containment vessel of about 6 to 8 feet will take up a portion of the inside capacity. Such a vessel will have about 500 barrel capacity.

Suitable heavy duty roller systems are available commercially, as for example those from Peinemann Equipment company (See information and specifications at the web site www.peinemannequipment.com/products/bundle_cleaning/heavy_duty_rollers/). Peinemann Equipment Company makes Standard Heavy duty rollers, specially designed for the rotation of the heat-exchanger tube bundles that may be driven directly from a remote cabin. The rollers consists of one unit with driven rollers and one unit with non-driven rollers (excluding power pack). The rollers are driven by a hydraulic or pneumatic motor and can be connected to any power-pack. The long length of the rollers and the ability to increase the distance between the rollers, allow them to be used for any tube bundle (or other equipment) up to 30 T. The long length of the rollers makes it possible to support tube bundle at the baffle plates, even when the baffle plates cover only half of the tubes. Bearings fitted on each side of the rollers have a capacity of 50 T each, to avoid bearing damage and they are well protected from any dirt coming inside. The wall thickness of the rollers is 24 mm to avoid any damage on the rollers and because the hydraulic motor is fitted with a safety valve, which stops the bundle from rotating when the hydraulic pressure stops, it makes it a safe and reliable tool for any heat exchanger cleaning job. The present system provides a tracked hydro-blasting arm system that can be automated.

FIG. 2 also shows a tube lance assembly 180 at the back of the open section of the containment vessel. It is mounted on a hydraulically driven movable frame. No comparable frame is commercially available.

Figure 3:
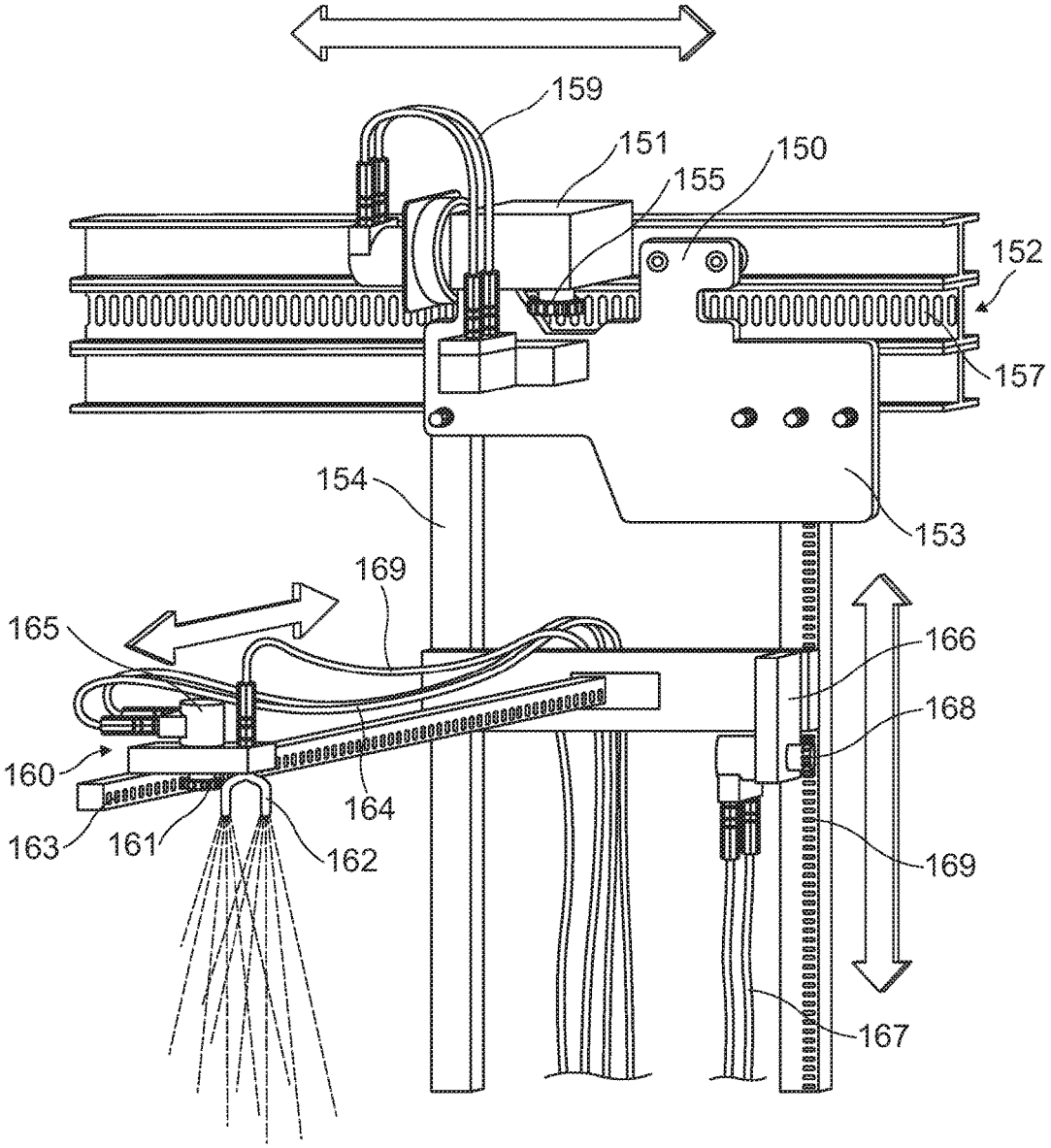
FIG. 3 is a perspective view of an embodiment of a hydro-blast arm and tractor and track system to move the arm of the invention.

FIG. 3 illustrates the hydro-blast arm tracking system. The tracking motor 150 comprises a hydraulic motor 151 and track mounting plate 153. The motor activates the gear 155 that engages the slots 157 in the track 152. The motor will move the system forward and back. Hydraulic lines 159 supplies the motor 151. The arm, 160, attached below the tracking track housing and is connected to the frame 154 to allow the arm to move up and down relative to the top and bottom of the container vessel. The arm 160 has a hydraulic motor 164 that drives gear 161 to move the hydro-jet structure along frame track 163. Hydro-blast water lines 169, 162 and 152 water needed to hydro-blast the equipment to be cleaned (exchanger tube bundle and the like). A vertical tracking motor 166 is supplied by hydraulic lines 167 activates gear 168 to move the arm up and down. All the functions to control movement of the arm, vertically, sidewise and from to back in the containment vessel may be manually controlled but are preferably controlled by programmable electronic controller means. Such means are not now commercially available. Preferred hydraulic driven systems are shown but they may also be pneumatic or electric.

In operation the hydro-blast (hydro-jet) arm will be moved to the back of the vessel (where the operator's cabin resides) and as high in the vessel as possible within the constraints of the tracking and frame assembly. This allows access for equipment to be placed in the container for cleaning. The hydro-blast arm is then positioned over the equipment (such as a tube bundle) for hydro-blast cleaning as described below. Hydraulic fluid (or air) and high pressure hydro-blast water is supplied external the containment vessel from a separate mobile unit that will be later described. The system as illustrated shows the arm arranged to move along the top side of the equipment to be cleaned. The arm(s) or multiple arms may alternatively be disposed to travel along the sides or sides of equipment to be cleaned and the operation will be similar. Such a side system is more complex to control and the top travel system is preferred.

Figure 4:
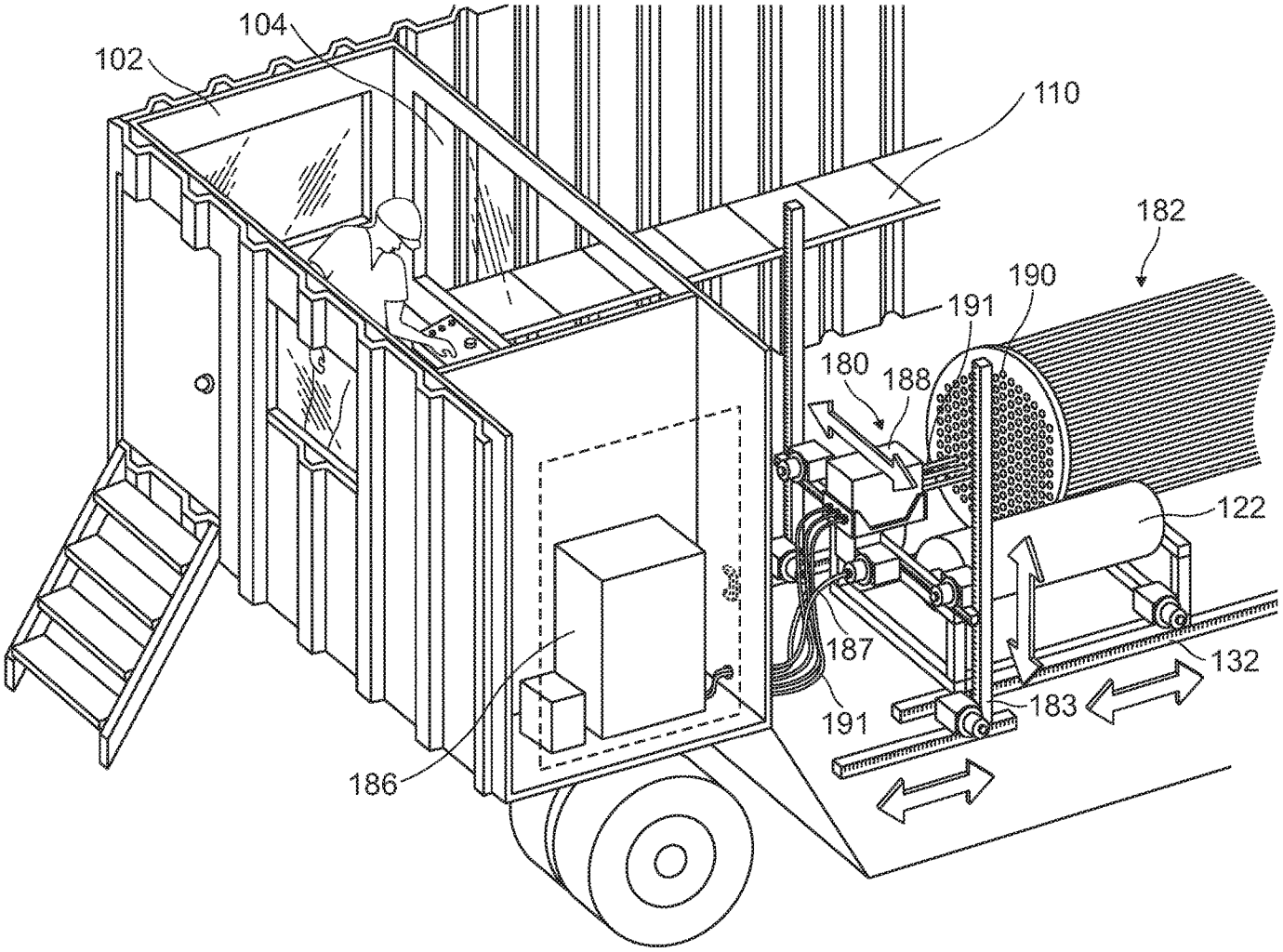
FIG. 4 is a perspective view of an embodiment of a hydro-blast cleaning containment system of the invention showing an operator's cabin and tube cleaning system.
Figure 5:
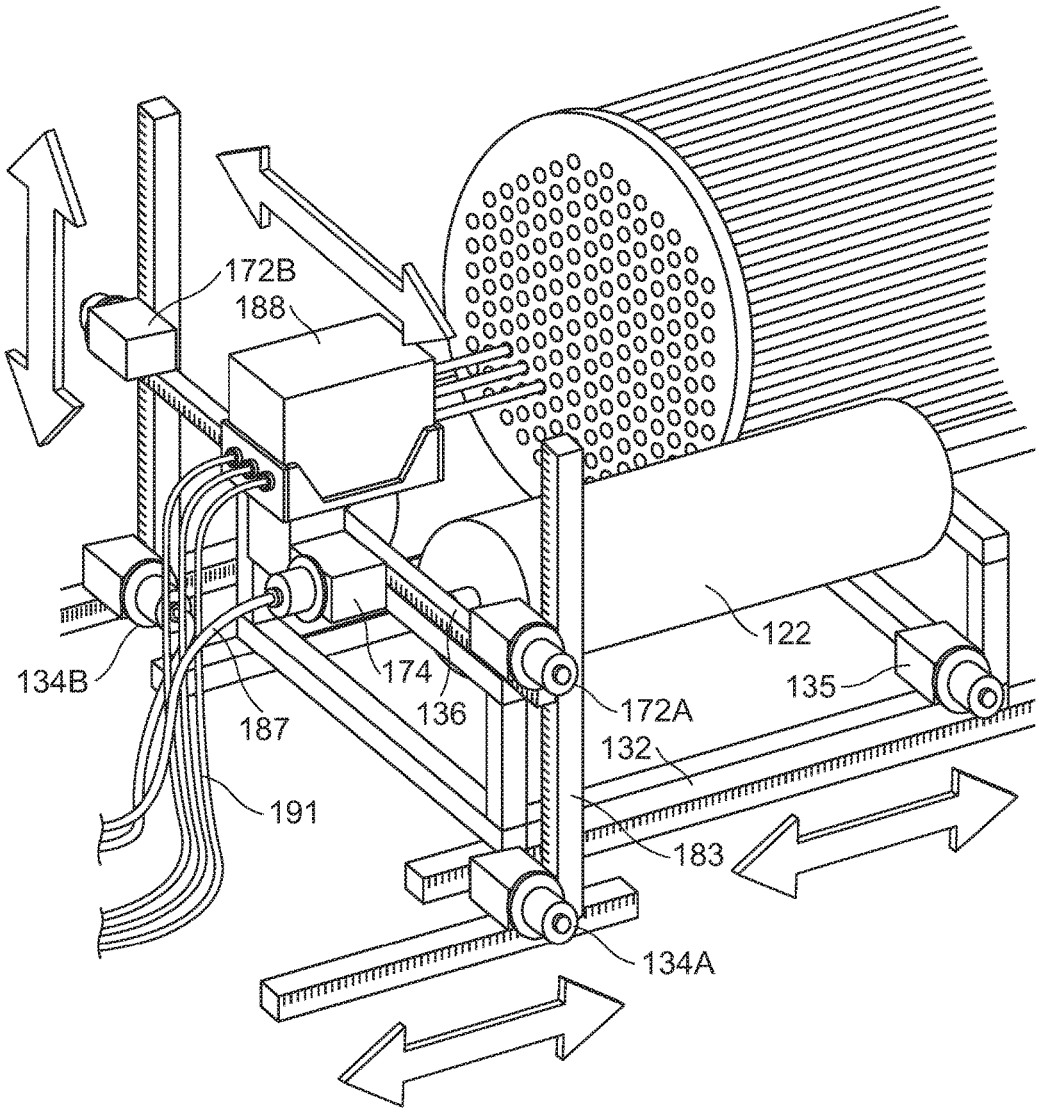
FIG. 5 is a perspective view of an embodiment of a tube cleaning system of an embodiment of the invention.

FIG. 4 and FIG. 5 illustrates the cabin, 102, control assembly container 186 and components of a suitable tube lance system, 180, for hydro-blasting the inside of exchanger tubes. The tube lance system is an adaptation of commercially available systems such as those of Peinemann Equipment. Basically it is a system that feeds blasting hose, 191, having a rotating jet nozzle on the ends, into tubes of a tube bundle with a jet of high pressure liquid (usually water) to clean the inside of the tubes. The Figure shows the hose feed unit 188 and hose 181. The unit is mounted on a frame 183 with pneumatic or hydraulic motors, 134A, 134B, 135, 172A and 172B that operate rollers to move the tube lance hose feed unit (and therefore the hose) up, down and sideways to allow the hose to access the tubes 190 of the tube bundle 182. Motor 174 operates rollers to move the lance system from side to side. As described above the tube bundle is supported on roller assembly 122 to allow rotation. The operation of the tube lance system may computer controlled with a preprogrammed control system. A suitable and preferred lance system with be a three lance system adapted from and using components of a Peinemann Equipment system such as its 3XLTC system. (Peinemann USA, 22820 I-H 45 N., Bldg. #7, Ste. P, Spring, Tex. 77373). A system with Automated Hole Location technology (from Peinemann Equipment or specially customer designed) is preferred.

Figure 6:
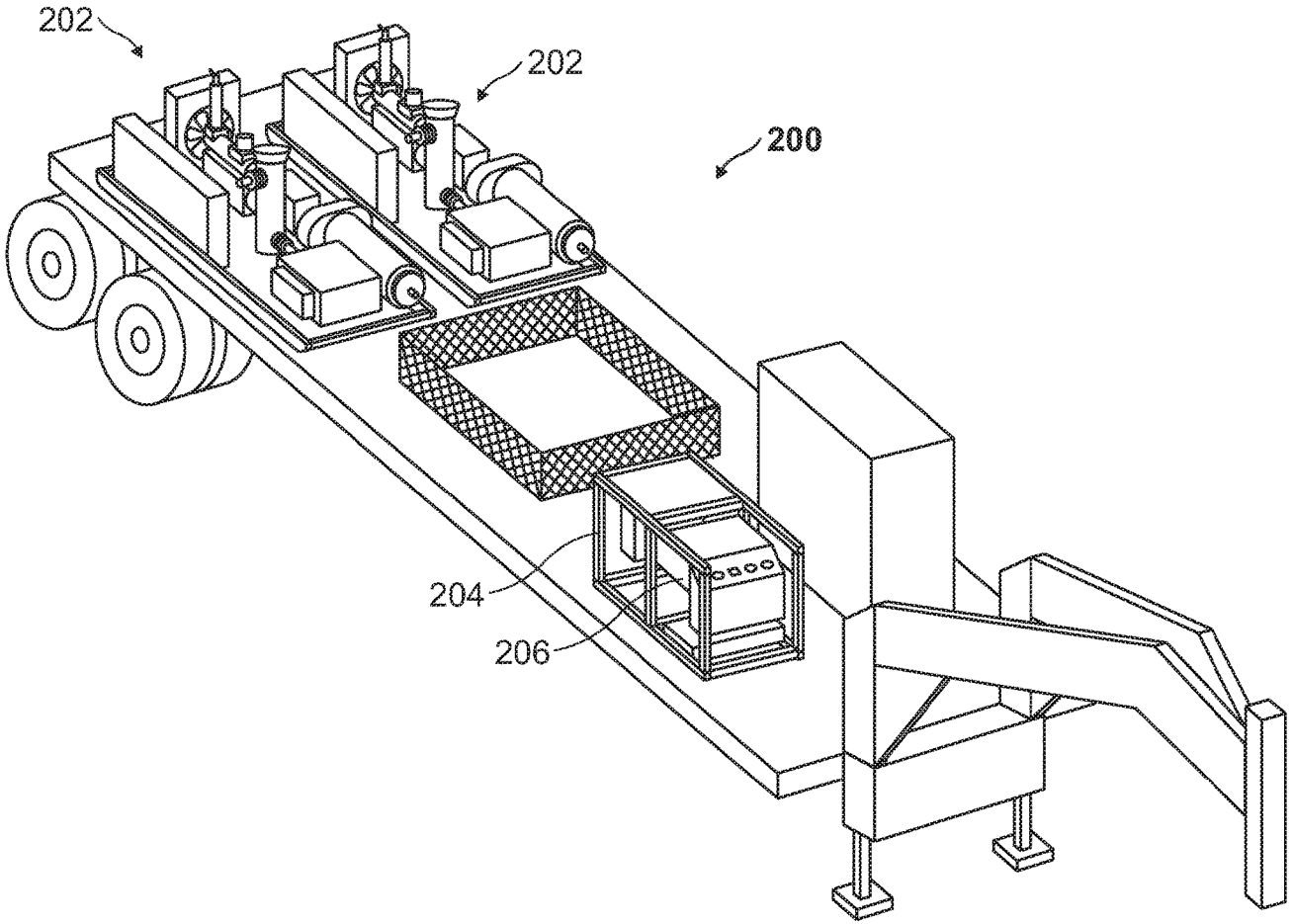
FIG. 6 is a perspective view of a pumping trailer system of an embodiment of the invention.

FIG. 6 shows an embodiment of a separate trailer, 200, that houses high pressure pumps, 202, to supply the water (or other liquid) for hydro-blasting and/or tube lancing. It also contains the pump system for the hydraulic systems of the invention, Item 204 is a frame and 206 is the hydraulic pump system. For example pumps that will generate 40,000 psi pressure at 200 gallons per minute (gpm) are suitable and allow sufficient liquid volume and pressure for adequate cleaning of most equipment. Liquid pressures of about 20,000 psi at 30 gpm are suitable for the tube lance cleaning systems. Much higher pressures and flow rates can be obtained by pumping systems such as those used in hydrofacturing ("Fracing") operations but are very expensive and generally not needed for the applications of the present invention. The trailer, 200, will be placed at the rear of the containment vessel tank to allow an operator to observe and operate the equipment properly. A vacuum truck or other liquid collection system may be placed at the front or side of the containment tank to collect waste fluids (from the outlet port 106, 107 or other drain ports). The containment vessel will contain any fluid that comes out of or off of the hydro-blasted and lanced equipment, eliminate human interaction with hazards materials or situations, and increases the turnaround rate of products being hydro-blasted and lanced.

Figure 7:
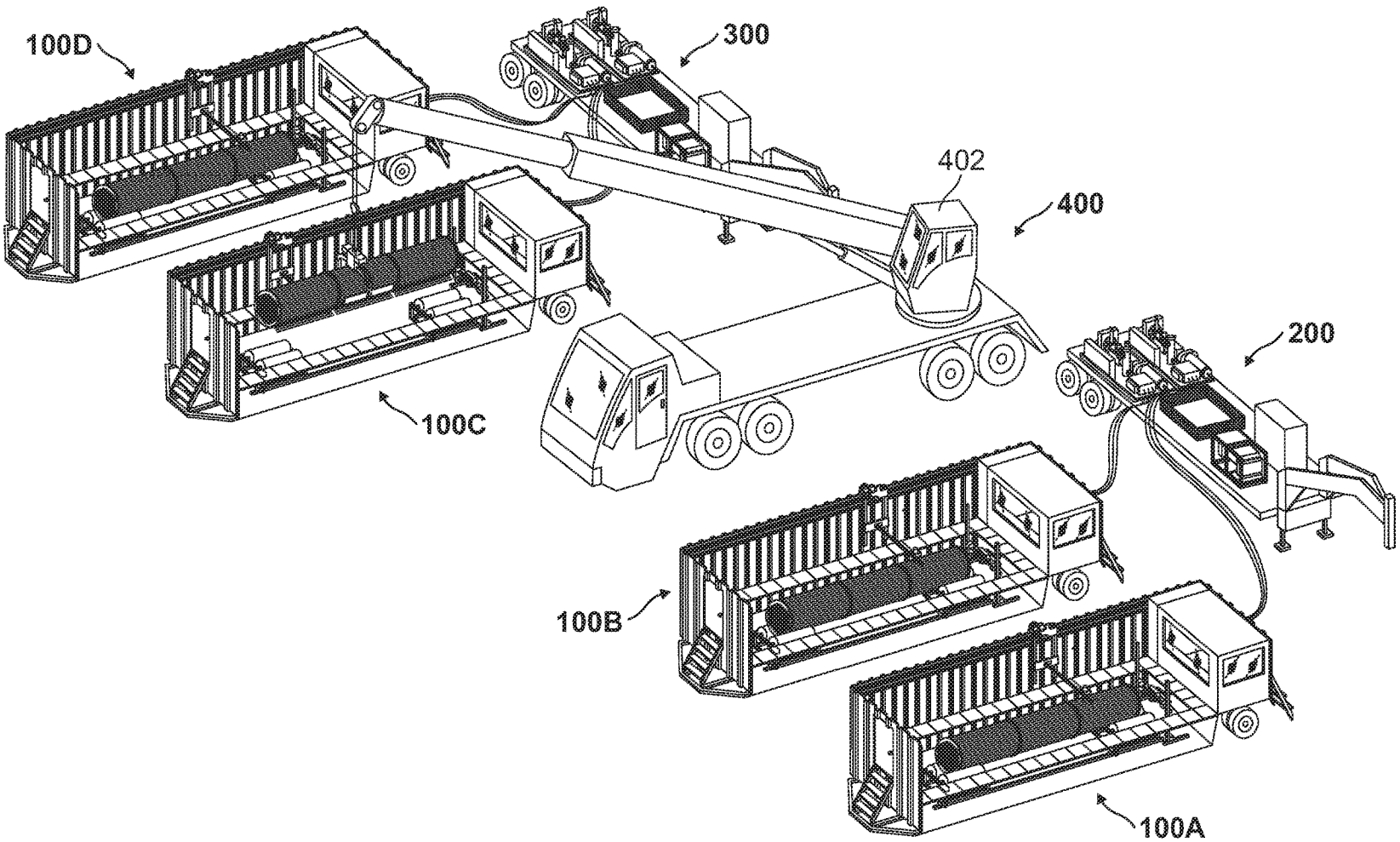
FIG. 7 is a perspective view of an array of hydro-blast cleaning containment system units deployed for use in simultaneously cleaning several pieced of equipment.

FIG. 7 shows a typical array of embodiments of the invention is position for operation. Containment vessel trailers 100A, 100B, 100C and 100D are positioned to receive and clean equipment (exchanger tube bundles are shown). One pump truck 200 or 300 can supply two containment/cleaning vessels and a single crane truck 400 with a suitable crane 402 used to lift and retrieve the equipment from the containment vessels 100A, 100B, 100C and 100D.

Control System

The control system will be housed in the container 186 (FIG. 4) with a connected operator interface inside the operator's cabin 102. The operator interface may connected to the control system by wires or wirelessly. The cabin will have an access door and window(s), one facing the open containment vessel to allow an operator to observe the operations. The window will generally be enclosed with a transparent material such and glass or Plexiglas. Windows on the rear and/or side to allow viewing of auxiliary trailers are also preferred.

The control system will be a suitably programmed computer system designed specifically for this system. It can consist of specially adapted commercial control or a specially designed control system. The control system will comprise all the necessary valves and servomotors to operate the valves and motors necessary to operate the various systems on the invention. It may be programmed to automatically perform specific cleaning functions. Most elements of the cleaning and containment system of the invention may be operated manually, or automated and computer controlled. Suitable computer programs will be used to automate the hydro-blasting of equipment and tube bundles and for the tube lance tube cleaning system. These may or may not be integrated.

Typical Operation of the System

Operation of the system of the invention can be illustrated in reference to the cleaning of an exchanger tube bundle, for example a 24 inch diameter 20 foot long bundle. It will be removed from its shell by special heavy duty bundle extraction equipment that is commercially available and not a part of the present invention. Such a tube bundle system is demonstrated in the youtube video available at www.youtube.com/watch?v=vhLZPldusZk.

Containment vessel units, pump truck and crane trailer will be arrayed at the facility from which the tube bundle is taken (Refinery, Chemical plant, etc.) as illustrated in FIG. 7. The container vessel will be prepared by moving the hydro-blast arm (160) of its travel and forward in the vessel to the back (above the tube cleaning apparatus and back walkway, 112). The rollers (or other support) are moved into proper position and the exchanger is lifted into position in the containment vessel (100) with a bundle baffle plate resting on the rollers. The hydro-blast arm is then positioned above the top of the bundle as close as practicable. The hydro-blast arm tractor is activated to move the jet on the arm the length of the tube bundle with the liquid ejecting from the jets onto the surface of the bundle (or other equipment to be cleaned). With a standard two jet (rotating) system and 40,000 psi pressure the jet path width will be about 8 inches. To insure overlap the bundle will be rotated (with the rollers) sufficiently to move the top of the bundle about 6 inches and another traverse of the hydro-blast arm will be made. This is repeated until the entire circumference of the tube bundle has been exposed (to the top) and cleaned.

The front of the tube bundle will be positioned in line with the tube cleaning unit 180 and each of the tubes will have the lance hoses inserted, liquid supplied, and the inside of the tubes cleaned. This can be accomplished manually or can be automated. Automation system are commercially available. The hydro-blast cleaning and automated tube cleaning can be accomplished by an operator from the Operator's cabin where the operator can observe and override each operation.

Water and debris from the hydro-blast and tube cleaning operation will all be contained in the containment vessel and off loaded into transport vehicles (vacuum trucks and the like) or piped to suitable disposal systems at the facility. Thus, there will be no contaminated residue from the cleaning operation that is not contained and controlled. Since the tube bundles are often in service with toxic substances, such containment is essential and will likely be mandated.

In this specification, the invention has been described with reference to specific embodiments. It will, however, be evident that various modifications and changes can be made thereto without departing from the broader spirit and scope of the invention as set forth in the appended claims. The specification is, accordingly, to be regarded in an illustrative rather than a restrictive sense and the scope of the invention should be limited only by the appended claims.

The invention claimed is:

1. A multi-function mobile, self-contained hydro-blast cleaning and tube lancing system comprising:

an open top water tight containment vessel have an inside and outside top, sides and bottom and having equipment support means disposed on the inside bottom;

a hydro-blast tract system disposed along one inside wall;

a hydro-blast arm having hydro-blast jets;

a hydro-blast arm tractor unit disposed to travel along the hydro-blast track;

a frame and motors to allow the hydro-blast arm to move up and down relative to the top and bottom of the containment vessel;

means to power the motors of the system; and supply lines for high pressure liquid to the hydro-blast arm jets.

2. The system of claim 1 comprising an enclosed operator's cabin disposed into one end of the containment vessel.

3. The system of claim 2 comprising a heat exchange tube lance system located in front of the operator's cabin.

4. The system of claim 1 wherein the equipment support means comprise a roller system configured to support and rotate circular equipment disposed thereon.

5. The system of claim 1 wherein the hydro-blast motors and supply of liquid is computer controlled.

6. The system of claim 1 wherein the bottom is flat, V shaped, or concave and has outlet ports to drain liquid from the containment vessel.

7. The system of claim 1 wherein the motors of the system are hydraulically driven.

8. The system of claim 1 disposed on a mobile unit having wheels or mounted on a trailer.

9. The system of claim 8 comprising high pressure liquid supply means disposed in a separate unit from the containment vessel.

10. A cleaning system for fouled equipment comprising a hydro-blast arm with jet nozzles mounted on tracked frames that allow it to move up and down and back and forward over equipment to be cleaned, wherein the system is housed in a containment vessel that has inside and outside walls and a bottom to collect water and debris from hydro-blast cleaning with the water pumped through the hydro-blast arm and the tracked frames attached to the inside walls.

11. The cleaning system of claim 10 wherein movement of the arm is automated and controlled by a programmed computer system.

12. The cleaning system of claim 10 wherein the containment vessel also has an exchanger tube lancing system that has lance hoses and that is mounted on tracks to move exchanger tube lancing system into positions to place lance hoses into exchanger tubes.

13. The cleaning system of claim 12 wherein the exchanger tube lancing system is automatically controlled with a programmed computer control system.

14. The cleaning system of claim 10 comprising support means disposed on the bottom of the containment vessel to support equipment be cleaned.

15. The cleaning system of claim 12 comprising hydraulic motors to drive movement of the hydro-blast arm and exchanger tube lancing system.

* * * * *